US008870562B2

(12) United States Patent
Hong

(10) Patent No.: US 8,870,562 B2
(45) Date of Patent: Oct. 28, 2014

(54) MOTIF-ARRAYING APPARATUS

(76) Inventor: Duk Haui Hong, Bucheon-si (KR)

( * ) Notice: Subject to any disclaimer, the term of this patent is extended or adjusted under 35 U.S.C. 154(b) by 0 days.

(21) Appl. No.: 13/380,822

(22) PCT Filed: Jun. 7, 2010

(86) PCT No.: PCT/KR2010/003630

§ 371 (c)(1),
(2), (4) Date: Dec. 24, 2011

(87) PCT Pub. No.: WO2010/150990

PCT Pub. Date: Dec. 29, 2010

(65) Prior Publication Data

US 2012/0093962 A1 Apr. 19, 2012

(30) Foreign Application Priority Data

Jun. 25, 2009 (KR) ..... 10-2009-0057245

(51) Int. Cl.
*B29C 65/40* (2006.01)
*D06Q 1/10* (2006.01)

(52) U.S. Cl.
CPC ..... *D06Q 1/10* (2013.01)
USPC ..... 425/472; 156/539; 156/562; 221/171; 221/173; 414/757; 414/781; 425/123; 425/126.1

(58) Field of Classification Search
USPC ..... 425/123, 126.1, 432, 472; 156/297, 156/539, 541, 556, 558, 560, 561, 562; 221/171, 173; 414/757, 758, 781
See application file for complete search history.

(56) References Cited

U.S. PATENT DOCUMENTS

| | | | | |
|---|---|---|---|---|
| 4,204,610 | A * | 5/1980 | Schlaepfer | 414/781 |
| 5,167,743 | A * | 12/1992 | Chalfin | 221/173 |
| 2005/0076998 | A1 * | 4/2005 | Buffum et al. | 156/539 |

FOREIGN PATENT DOCUMENTS

| | | |
|---|---|---|
| KR | 20-1989-0012409 | 8/1989 |
| KR | 10-2004-0051372 | 6/2004 |
| KR | 20-0418319 | 6/2006 |
| KR | 10-2007-0006287 | 1/2007 |

OTHER PUBLICATIONS

International Search Report for PCT/KR2010/003630 mailed Feb. 24, 2011.

* cited by examiner

*Primary Examiner* — James Mackey
(74) *Attorney, Agent, or Firm* — Revolution IP, PLLC

(57) ABSTRACT

A motif-arraying apparatus for arraying motifs such as a hot fix or the like in mounting grooves formed in a mold plate. The motif-arraying apparatus includes a shaking member for loading motifs in the mounting grooves formed in the mold plate, wherein the shaking member includes a vertical board and a horizontal board coupled to an edge thereof, and a plurality of shaking knives coupled to the bottom surface of the vertical board at a predetermined interval. The apparatus not only enables motifs to be correctly arrayed in the mounting grooves formed in the mold plate in a quick and easy manner, but also enables a motif inserted in a wrong direction to be removed from the mounting groove and correctly arrayed, thereby improving productivity, minimizing defects, and reducing costs.

3 Claims, 4 Drawing Sheets

MOTIF-ARRAYING APPARATUS

RELATED APPLICATIONS

This application is a 371 application of International Application No. PCT/KR2010/003630, filed Jun. 7, 2010, which in turn claims priority from Korean Patent Application No. 10-2009-0057245, filed Jun. 25, 2009, each of which is incorporated herein by reference in its entirety.

TECHNICAL FIELD

The present invention relates to a motif-arraying apparatus, and in particular to a motif-arraying apparatus in which a plurality of hot-fix materials discharged from a storing box storing a plurality of hot-fix materials therein are fast arrayed in a mounting groove of a mold in correct postures.

BACKGROUND ART

A certain image such as characters, numbers, images or the like is expressed or decorated on a surface of a clothes with the aid of hot-fix materials such as rhinestones, studs or the like.

As shown in FIGS. 1 and 2, a plurality of hot-fix materials H are positioned on a mold plate 10 with a plurality of mounting grooves 10*a* for forming a certain image in order to express or decorate various motifs, and the hot-fixe materials H are inserted into the mounting grooves 10*a* by using a tool such as a sponge or the like, thus forming a certain image, and then the hot-fix materials H mounted in the mounting groove 10*a* are attached to an adhesive tape with its one side being applied with cohesive, and the attached hot fix materials are attached to a clothes or the like based on a thermal compression method.

The conventional hot-fix materials arraying method is generally performed in a manual method using a sponge or the like, thus arraying hot-fix materials in a mounting groove of a mold plate, which takes a lot of time to array, which results in lowering the productivity, and as shown in FIG. 2, it is very hard to invert again the once inverted hot-fix materials inserted in the mounting groove for accurate arrangement, so product defects increase.

DISCLOSURE OF INVENTION

Accordingly, it is an object of the present invention to provide a motif-arraying apparatus which overcomes the problems encountered in a conventional art and is directed to making a process of inserting hot-fix materials such as rhinestones, studs or the like into a mounting groove of a mold plate and arraying the same easier and faster and escaping the inverted and inserted hot-fix materials and re-arraying the same, thus improving productivity and minimizing defect ratios, which results in decreasing the costs.

To achieve the above objects, there is provided a motif-arraying apparatus, comprising a shaking part for mounting hot-fix materials in a mounting groove formed at a mold plate, the shaking part formed of cross sheet bars and two lengthwise bars which are coupled to an edge portion; and a plurality of shaking crossbar knifes which are coupled at a lower surface of the shaking part at regular intervals.

ADVANTAGEOUS EFFECTS

The motif-arraying apparatus according to the present invention is basically directed to making the process of both inserting hot-fix materials and arraying the same easier and faster and escaping the inverted and inserted hot-fix materials and re-arraying the same in correct shapes, thus improving productivity and minimizing defect ratios, which results in decreasing the costs.

BRIEF DESCRIPTION OF THE DRAWINGS

The present invention will become better understood with reference to the accompanying drawings which are given only by way of illustration and thus are not imitative of the present invention, wherein.

BEST MODES FOR CARRYING OUT THE INVENTION

The preferred embodiments of the present invention will be described with reference to the accompanying drawings.

Figure 1:
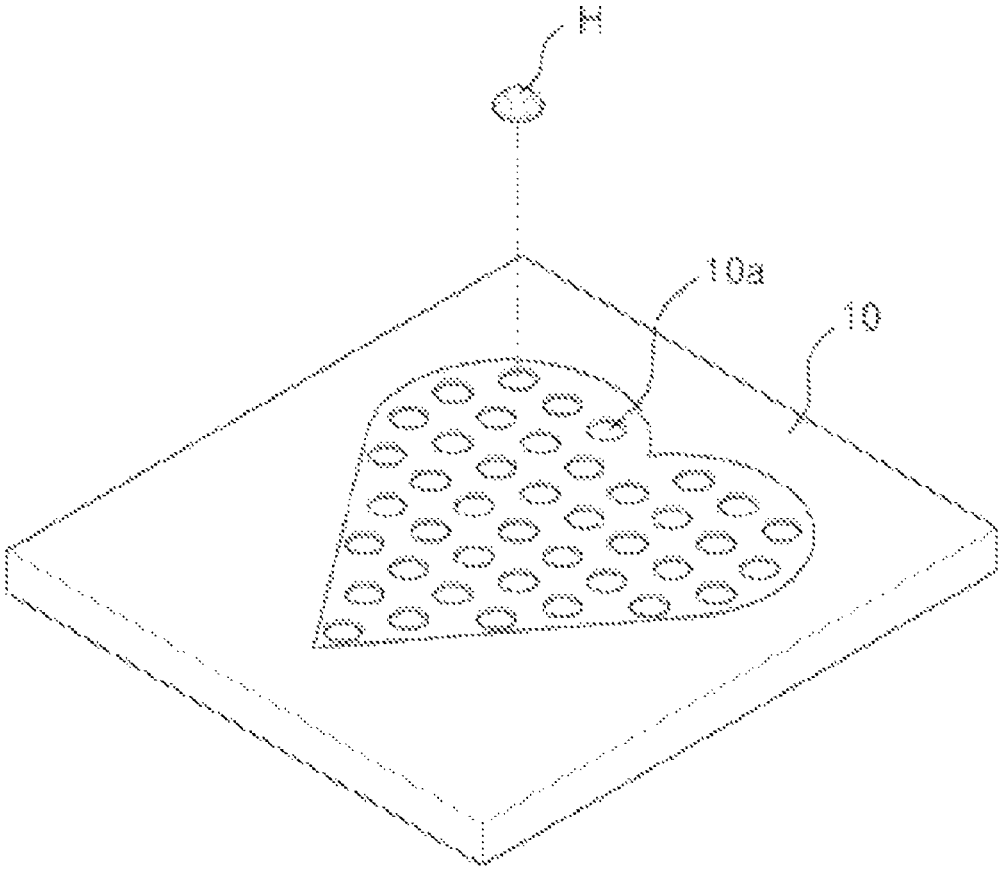
FIG. 1 is a perspective view illustrating a state that hot-fix materials are arrayed in a conventional mold plate.
Figure 2:
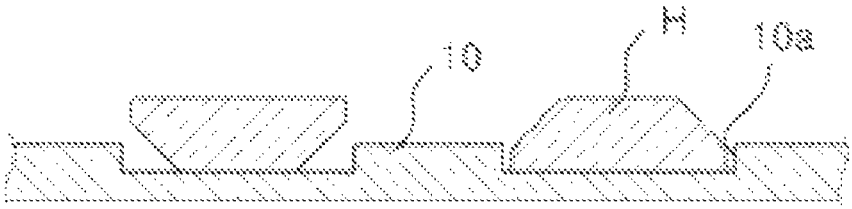
FIG. 2 is a partially enlarged cross sectional view illustrating a state that hot-fix materials are inserted in a mounting groove of a conventional mold plate.
Figure 3:
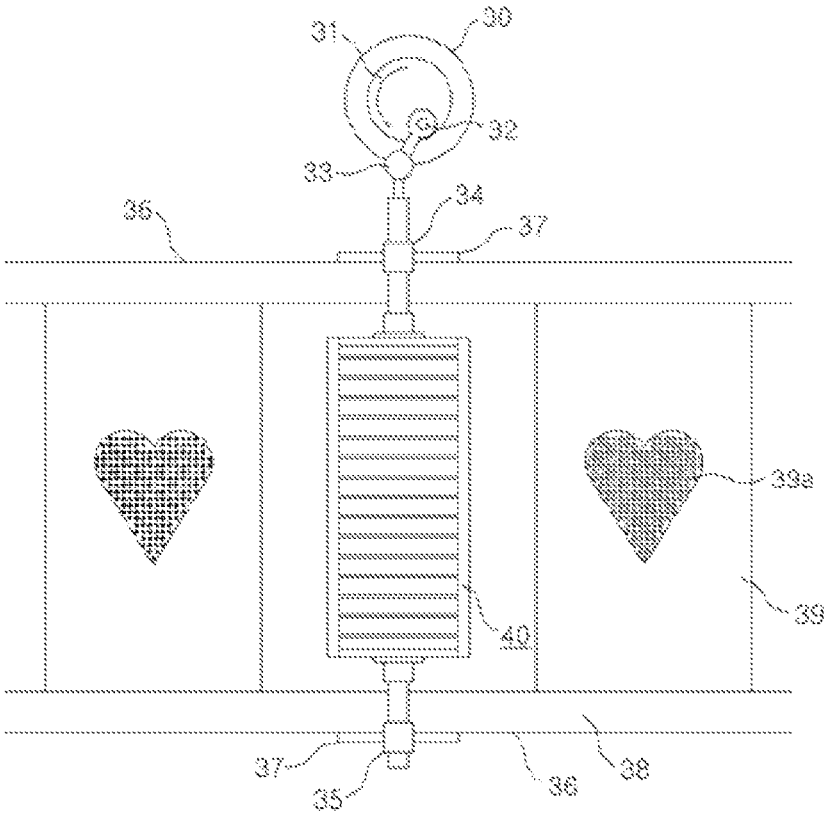
FIG. 3 is a schematic entire plane view illustrating a motif-arraying apparatus according to the present invention.

FIG. 3 is a schematic view when plane-viewing a motif-arraying apparatus according to the present invention comprising a cam 31 rotating based on a driving operation of a driving motor 30. A joint 33 is coupled to a cam shaft 32 eccentrically disposed at one side of the cam 31. The front end portion of the joint 33 is coupled to a linear motion guide 34 which is coupled to one side of a shaking part 40.

To the other side of the shaking part 40 is coupled a linear motion guide 35, and the linear motion guides 34 and 35 are coupled to a bracket 37 engaged at a base 36.

The linear motion guide 34 is fixedly coupled to both sides of the shaking part 40, but it is not limited thereto. Alternatively, it can be fixed in such way that the axis of the linear motion guide 34 passes through the shaking part 40.

At an upper side of the base 36 is installed a conveyor belt 38 which rotates depending on the operation of the driving means, and a mold plate 39 is mounted at an upper side of the conveyor belt 38 in order to array the hot-fix materials M such as rhinestones, studs or the like.

At the mold plate 39 are formed a plurality of mounting grooves 39*a* in which hot-fix materials M are mounted.

Figure 4:
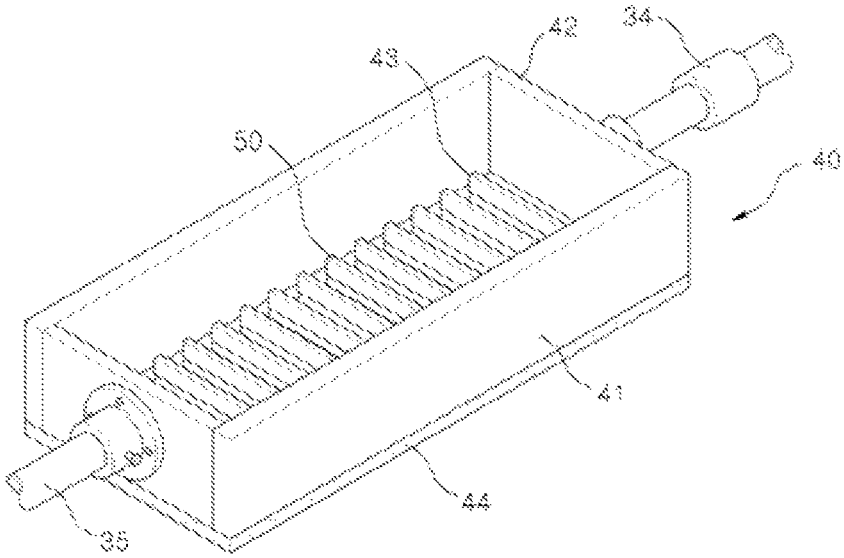
FIG. 4 is a perspective view illustrating a shaking part of a motif-arraying apparatus according to the present invention.
Figure 5:
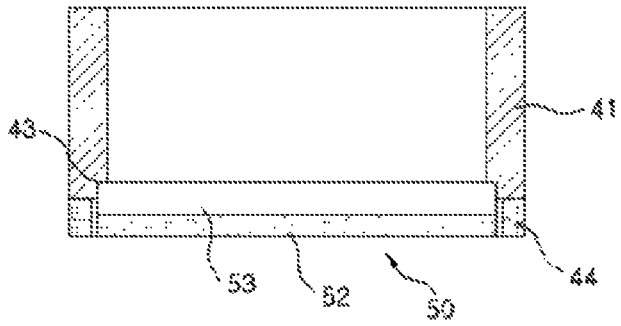
FIG. 5 is a cross sectional view illustrating a shaking part of a motif-arraying apparatus according to the present invention.

As shown in FIGS. 4 and 5, the shaking part 40 comprises a pair of lengthwise sheet bars 41, and a cross sheet bar 42 coupled to a front end portion of each of the lengthwise sheet bars 41. A plurality of coupling grooves 43 are formed at a lower side of each of the lengthwise sheet bars 41 at regular intervals. Each shaking crossbar knife 50 is fixedly inserted into the plurality of the coupling grooves 43.

Figure 6:
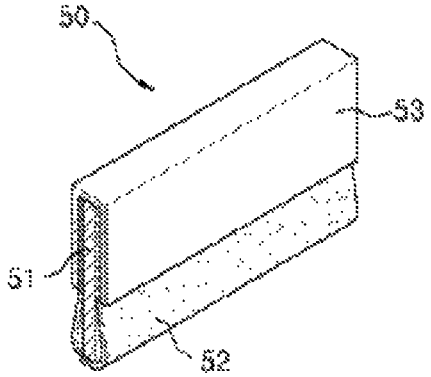
FIG. 6 is a partially cut-away perspective view illustrating a crossbar knifes of a motif-arraying apparatus according to the present invention.

As shown in a partial cut-away perspective view of FIG. 6, the shaking crossbar knife 50 is formed of a rubber elastic plate 51 at an inner side, and a contact part made from a fiber material or the like is formed at an outer side of the elastic plate 51. The contact part 52 has an elastic force at its front end portion and is rounded.

The elastic plate 51 and the contact part 52 are fixed by means of a metallic fixing bracket 53, respectively.

An elastic part 44 generally formed of a sponge or the like is provided at each edge portion of the lower surface of the shaking part 40.

The elastic part 44 serves to prevent the plurality of hot-fix materials M positioned at an inner side of the shaking part 40 from escaping.

In the motif-arraying apparatus according to the present invention, a plurality of hot-fix materials M are prepared at an inner side of the shaking part 40 and are transferred by means of the conveyer belt 38 disposed below, and then the hot-fix materials M are arrayed depending on the operation of the shaking part 40 while the mold plate 39 passes through certain positions.

The transfer method of the mold plate 39 is not limited to the method of transferring by means of the conveyer belt 38. Alternatively, a linear motion guide 34 might be installed at the conveyer belt 38 along with one or a plurality of bearing guides with the mold plate 39 being fixed at the table, and the linear motion bearings are coupled to the bracket 37, so the motor and the shaking part moves together in left or right directions, thus arraying the hot-fix materials M.

When the cam 31 and the cam shaft 32 rotate depending on the operation of the driving motor 30, the rotational force of the same is transferred to the shaking part 40 through the joint 33 and the linear motion guide 34.

Therefore, the shaking part 40 repeatedly performs a shaking operation within a certain section, and the plurality of the hot-fix materials M positioned in the shaking part 40 are mounted in the mounting groove 39*a* of the mold plate 39 positioned at a lower side depending on the operation of the crossbar knifes 50.

Figure 7:
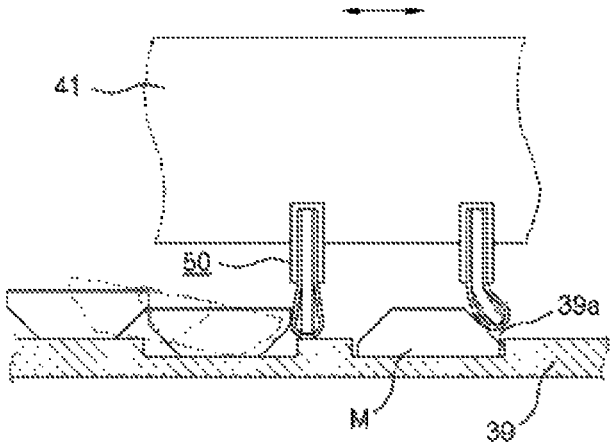
FIG. 7 is a partially enlarged cross sectional view illustrating an insertion state of a hot-fix material of a motif-arraying apparatus according to the present invention.

At this time, as shown in FIG. 7, when the hot-fix materials M inserted in the mounting groove 39*a* of the mold plate 39 are inserted in the inverted shapes, the shaking crossbar knife 50, which repeatedly shakes in the horizontal direction, lets the hot-fix materials M inserted in the mounting groove 39*a* escape, so new hot-fix materials M are mounted in correct postures in the mounting groove 39*a*.

In the embodiment of the present invention, the shaking part 40 is designed to shake depending on the operation of the driving motor 30, however it is not limited thereto. Alternatively, a worker can shake manually.

Figure 8:
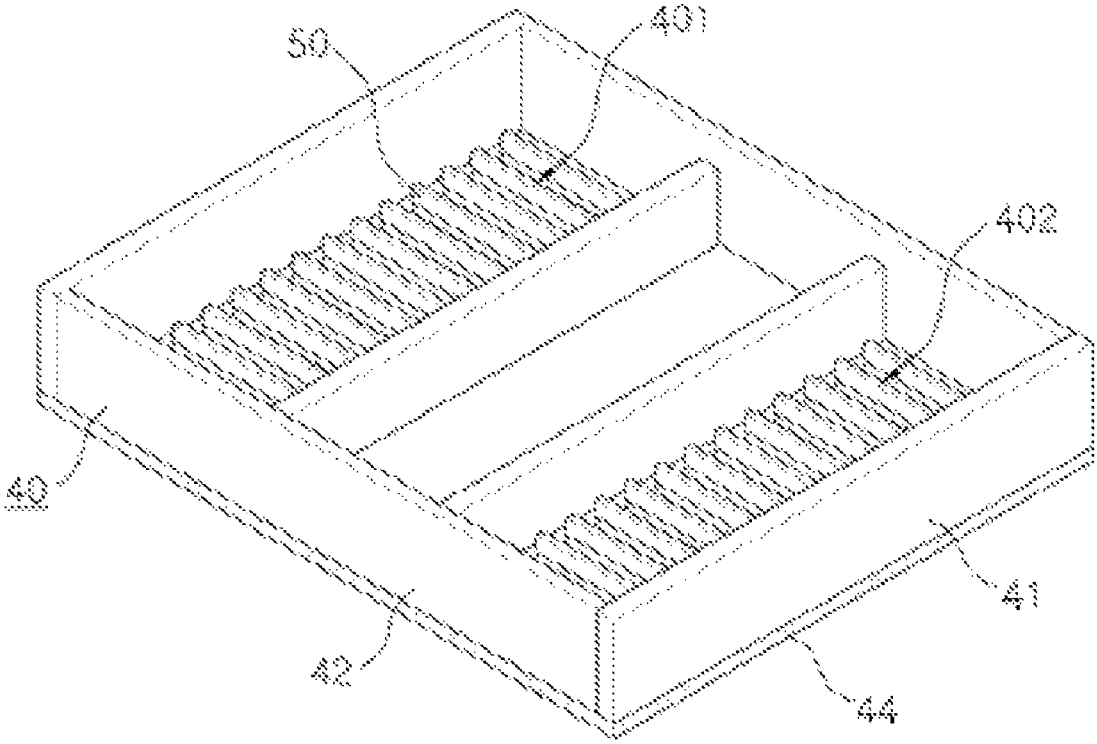
FIG. 8 is a perspective view illustrating a shaking part of a motif-arraying apparatus according to another embodiment of the present invention.

FIG. 8 is a view of a motif-arraying apparatus according to another embodiment of the present invention and shows another aspect of the shaking part 40.

In the drawings, the shaking part 40 is the same as one embodiment of the present invention, provided that a plurality of shaking parts 401 and 402 are disposed at both sides.

Each shaking part 401, 402 is characterized in that a plurality of shaking crossbar knifes 50 are coupled at regular intervals at its lower side, with an elastic member 44 such as a sponge or the like being attached to an edge portion of a lower surface.

It is possible to array hot-fix materials M, at a time, by using two mold plates 39, so workability can be enhanced, and productivity can be improved, which leads to saving costs.

The above-described embodiments of the present invention are not limited thereto, and it is obvious that an ordinary person skilled in the art can modify the claimed invention in various forms without departing from the scope of the claimed invention.

INDUSTRIAL APPLICABILITY

It is appreciated that the present invention can be well applied to arraying hot-fix materials such as rhinestones, studs or the like in a mounting groove having a certain shape formed at a mold plate.

The invention claimed is:

1. A motif-arraying apparatus, comprising:

a shaking part for mounting hot-fix materials in a mounting groove formed at a mold plate, said shaking part formed of:

a pair of lengthwise sheet bars and a pair of cross sheet bars which are coupled to ends of the pair of lengthwise sheet bars; and a plurality of shaking crossbar knives which are coupled at a lower surface of the pair of lengthwise sheet bars.

2. The motif-arraying apparatus according to claim 1, wherein an elastic part is attached to a lower surface of the shaking part for preventing escape of hot-fix materials.

3. The motif-arraying apparatus according to claim 1, wherein said shaking crossbar knives each comprise:

an elastic plate having an elastic force;

a contact part, with said contact part being made from a fiber material; and a fixing bracket coupling the elastic plate and the contact part.

* * * * *